US008791378B2

(12) United States Patent
Lan

(10) Patent No.: US 8,791,378 B2
(45) Date of Patent: Jul. 29, 2014

(54) KEYBOARD PREVENTABLE KEYCAPS FROM BREAKING OFF

(75) Inventor: Tianliang Lan, Guangdong (CN)

(73) Assignee: Shenzhen Doking Electronic Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/258,869

(22) PCT Filed: Feb. 28, 2011

(86) PCT No.: PCT/CN2011/071412

§ 371 (c)(1),
(2), (4) Date: Sep. 22, 2011

(87) PCT Pub. No.: WO2012/027978

PCT Pub. Date: Mar. 8, 2012

(65) Prior Publication Data

US 2013/0334021 A1 Dec. 19, 2013

(30) Foreign Application Priority Data

Aug. 31, 2010 (CN) ..... 2010 2 0513716 U
Dec. 21, 2010 (CN) ..... 2010 2 0672658 U

(51) Int. Cl.
*H01H 13/70* (2006.01)

(52) U.S. Cl.
USPC ..... 200/5 A; 200/345; 200/344

(58) Field of Classification Search
USPC ..... 200/345
See application file for complete search history.

(56) References Cited

U.S. PATENT DOCUMENTS 5,990,435 A * 11/1999 Chao ..... 200/517
6,960,733 B2 * 11/2005 Hanahara et al. ..... 200/314
7,671,291 B2 * 3/2010 Odanaka ..... 200/345
2012/0255845 A1 * 10/2012 Liang et al. ..... 200/344

FOREIGN PATENT DOCUMENTS

CN 201146119 * 11/2008 ..... H01H 13/12
CN 201282056 * 7/2009 ..... H01H 13/86

* cited by examiner

*Primary Examiner* — Renee S Luebke
*Assistant Examiner* — Ahmed Saeed
(74) *Attorney, Agent, or Firm* — Jackson IPG PLLC

(57) ABSTRACT

The present invention provides a keyboard preventable keycaps from breaking off, which comprises a keyboard main body, and a limit board fixed to the keyboard main body. The keyboard main body comprises a base board, a thin film circuit board mounted on the base board, an elastic body mounted above the thin film circuit board, a scissors structure, and a keycap. The center of the scissors structure is provided with a hollow part. The elastic body is located above the thin film circuit board and in the hollow part at the center of the scissors structure. The keycap is located on the elastic body. The scissors structure is mounted to the keycap and passes through the thin film circuit board to be moveably mounted to the base board. The keycap comprises a top surface and side surfaces connected with the top surface, and the side surface is provided with a locking part extending outwards therefrom. The limit board is provided with a plurality of openings corresponding to keycaps, the keycaps pass through the openings, and the limit board covers the locking parts. The present invention can effectively prevent the keycap from breaking off under an external force. Furthermore, the present invention has a certain dustproof function, has more stable keycaps, is efficient and durable to use, and facilitates miniaturization of the keyboard.

3 Claims, 8 Drawing Sheets

KEYBOARD PREVENTABLE KEYCAPS FROM BREAKING OFF

FIELD OF THE INVENTION

The present invention relates to a keyboard preventable keycaps from breaking off, and particularly to a keyboard which can prevent keycaps from breaking off, have better tactile feel, and is miniaturized.

BACKGROUND OF THE INVENTION

A keyboard as a general input device is widely used in computers and other various electrical devices. The structures of keys of a conventional keyboard are independent with each other. A certain gap is provided between the keycaps of keys, which makes the bottom edge of the keycap of a key exposed. The exposed bottom edge of a side surface of a keycap can be a point of force application that makes the keycap to break off easily under an external force, which will make a keyboard unusable and so bring much inconvenience to people using a keyboard daily.

Besides, a keyboard should have good tactile feel that involves a contact area between a keycap and a finger, and a stroke of the keycap, etc. A designer should consider about the technical parameters.

Moreover, a keyboard is more and more often used in the outdoors and in the public. But, while being used in the outdoors or in the public, since there is lots of dust in the external environment, the dust can easily pass through the gaps on the surface of the device to drop into the keyboard. The dust will accumulate day by day, and is hard to clean, which will result in adversely affecting the performance and the service life of the keyboard.

SUMMARY OF THE INVENTION

An object of the present invention is to provide a keyboard preventable keycaps from breaking off, which can effectively prevent the keycap from breaking off under an external force, and has a certain dustproof function; and of which the keycaps are more stable, efficient and durable to use, and facilitate miniaturization of the whole keyboard.

Another object of the present invention is to provide a keyboard preventable keycaps from breaking off, which makes the keycap with a bigger stroke for assuring the tactile feel of the key input and facilitating miniaturization of the whole keyboard at the same time.

To achieve the above mentioned objects, a keyboard preventable keycaps from breaking off of the present invention comprises a keyboard main body, and a limit board fixed to the keyboard main body. The keyboard main body comprises a base board, a thin film circuit board fixed on the base board, an elastic body fixed above the thin film circuit board, a scissors structure, and a keycap. The centre of the scissors structure is provided with a hollow part; the elastic body is located above the thin film circuit board and in the hollow part at the centre of the scissors structure. The keycap is located on the elastic body. The scissors structure is mounted to the keycap and passes through the thin film circuit board to be moveably mounted to the base board. The keycap comprises a top surface and side surfaces connected with the top surface, and the side surface is provided with a locking part extending outwards therefrom. The limit board is provided with a plurality of openings corresponding to keycaps, whereby the keycaps pass through the openings, and the limit board covers the locking parts.

A bottom surface of the limit board away from the top surface of the keycap is provided with a recess adjacent to the opening and corresponding to the locking part, and the locking part of the keycap is correspondingly received in the recess of the limit board.

The base board is provided with a groove corresponding to the locking part, and while pressing the keycap, the locking part of the keycap is correspondingly received in the groove of the base board.

The thin film circuit board is provided with a through hole corresponding to the groove of the base board.

The locking part is parallel to the top surface, and the side surface is perpendicular to the top surface.

The limit board is made of metal or plastic materials.

The advantages of the present invention are described as follows. A keyboard preventable keycaps from breaking off of the present invention can effectively prevent the keycap from breaking off under an external force. Furthermore, the keyboard has a certain dustproof function. The keycaps are more stable, efficient and durable to use, and facilitate miniaturization of the whole keyboard. By the recess of the limit board receiving the locking part, the keycap can get a comparatively long stroke, which can guarantee the tactile feel of the key input and facilitate miniaturization of the whole keyboard. Moreover, by the groove of the base board receiving the locking part, the keycap can further get a longer stroke, and the tactile feel of the key input can be further improved.

The characteristic and the technical solution of the present invention are best understood from the following detailed description with reference to the accompanying figures, but the figures are only for reference and explaining, not to limit the scope of the invention.

BRIEF DESCRIPTION OF THE DRAWINGS

The technical solution and the beneficial effects of the present invention are best understood from the following detailed description with reference to the accompanying figures and embodiments.

In the figures.

DESCRIPTION OF THE PREFERRED EMBODIMENTS

To further set forth the technical solution adopted by the present invention and the effects thereof, the present invention is described detailedly with reference to the following preferred embodiments and the accompanying figures.

Figure 1:
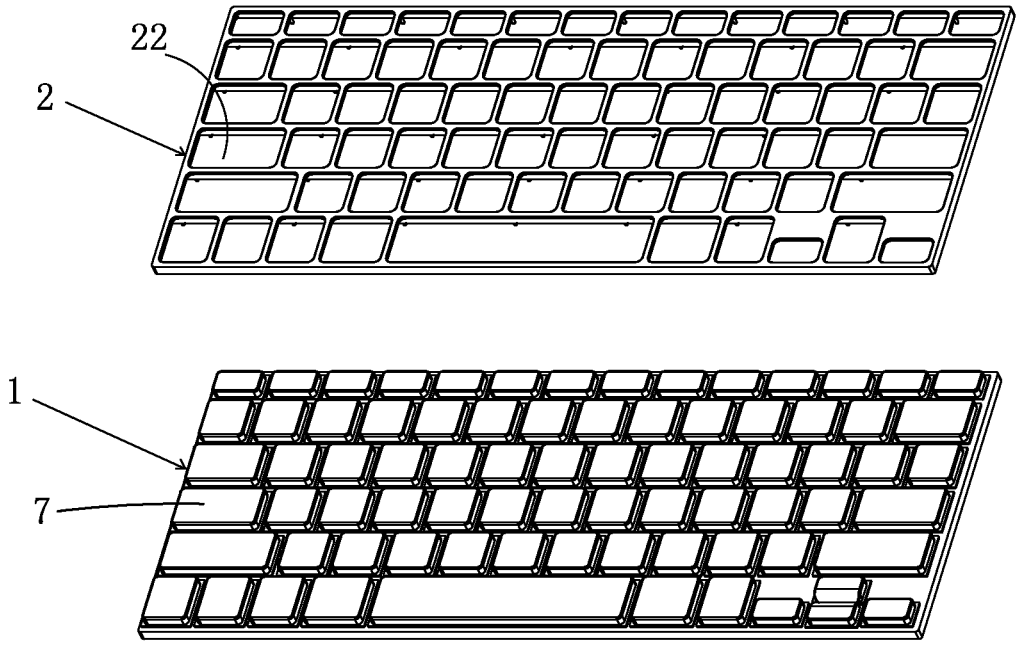
FIG. 1 is an exploded view of a keyboard preventable keycaps from breaking off in accordance with a first embodiment of the present invention.
Figure 2:
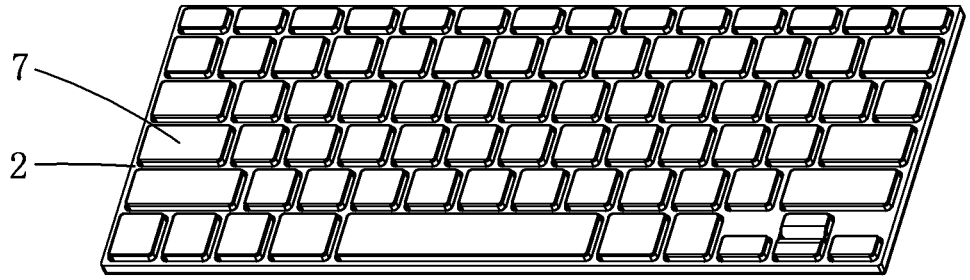
FIG. 2 is an assembled view of FIG. 1.
Figure 3:
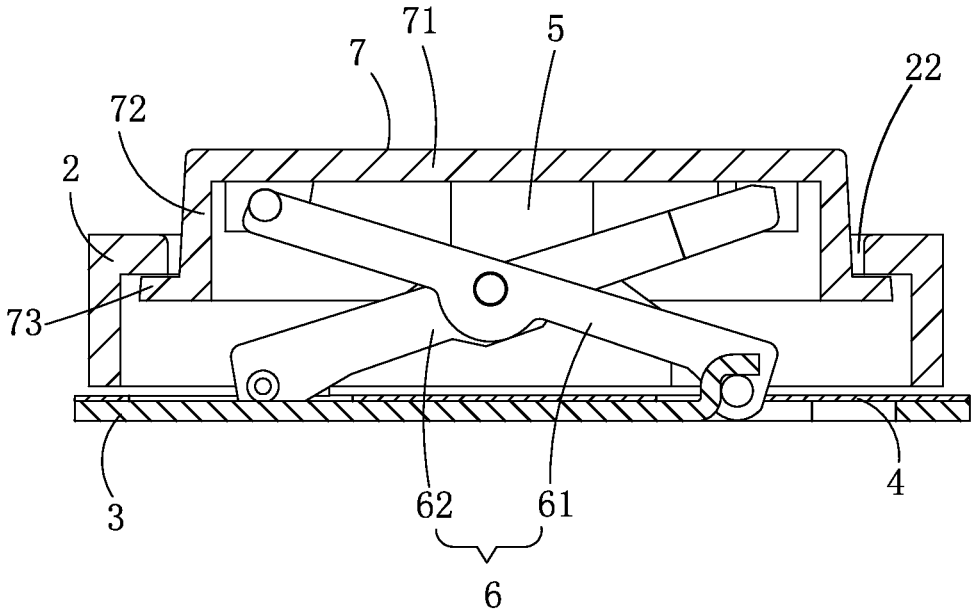
FIG. 3 is a sectional view of a key structure of the keyboard preventable keycaps from breaking off in FIG. 2.

As shown in FIGS. 1-3, a keyboard preventable keycaps from breaking off in accordance with a first embodiment of the present invention comprises a keyboard main body 1, and a limit board 2 mounted to the keyboard main body 1. The keyboard main body 1 comprises a base board 3, a thin film circuit board 4 fixed on the base board 3, an elastic body 5 mounted above the thin film circuit board 4, a scissors structure 6, and a keycap 7. The scissors structure 6 comprises a first frame 61, and a second frame 62 rotationally connected with lateral margins of the first frame 61. The centre of the scissors structure 6 is provided with a hollow part. The elastic body 5 is located above the thin film circuit board 4, and in the hollow part at the centre of the scissors structure 6. The keycap 7 is located on the elastic body 5. The scissors structure 6 is mounted to the keycap 7 and passes through the thin film circuit board 4 to be moveably mounted to the base board 3.

Particularly, the keycap 7 comprises a top surface 71 and side surfaces 72 connected with the top surface 71. The side surface 72 is provided with a locking part 73 extending outwards therefrom. The locking part 73 is parallel to the top surface 71, and the side surface 72 is perpendicular to the top surface 71, which is good for increasing an area of the top surface 71 in a limited space. The locking part 73 can be designed as any shapes, and the size of the locking part 73 can be designed according to the practical situation. Each keycap 7 can be provided with a locking part 73 at only one side surface 72, or a plurality of side surfaces 72 of each keycap 7 can be respectively provided with a locking part 73 which is in turn connected with each other. In the present embodiment, free ends of the four side surfaces 72 of the keycap 7 are all provided with locking parts 73 extending therefrom and in turn connected with each other. As an alternative of the present embodiment, the ends of any opposite side surfaces 72 of the keycap 7 are provided with locking parts 73 extending therefrom. The limit board 2 is provided with a plurality of openings 22 corresponding to the keycaps 7. The keycaps 7 pass through the openings 22. The limit board 2 covers the locking parts 73.

In assembly, the base board 3 is first put on a worktable, then the thin film circuit board 4 is mounted to the base board 3, then the elastic body 5, the scissors structure 6 and the keycap 7 is in turn mounted, and then cover the locking part 73 of the keycap 7 with the limit board 2. After assembly, bottom edges of the side surfaces 72 of the keycap 7 are not exposed, so, there is no point of force application for an external force to break the keycap 7 off, which can effectively prevent the keycap 7 from breaking off under an external force, thereby ensuring the service life and the service performance of a keyboard. The limit board 2 can also be used to cover the gaps between the spaced keycaps 7, so as to effectively prevent the external dust from passing through the gaps on the surface of the keyboard to drop into the keyboard, and so prevent the dust from affecting the electrical performance of the internal circuit of the keyboard. So, the arrangement of the present embodiment can protect the internal circuit of a keyboard at a certain extent, and can improve the durability of a keyboard. The limit board 2 can be made of metal or plastic materials, which have comparatively good anti-damage property to better protect a keyboard.

Figure 4:
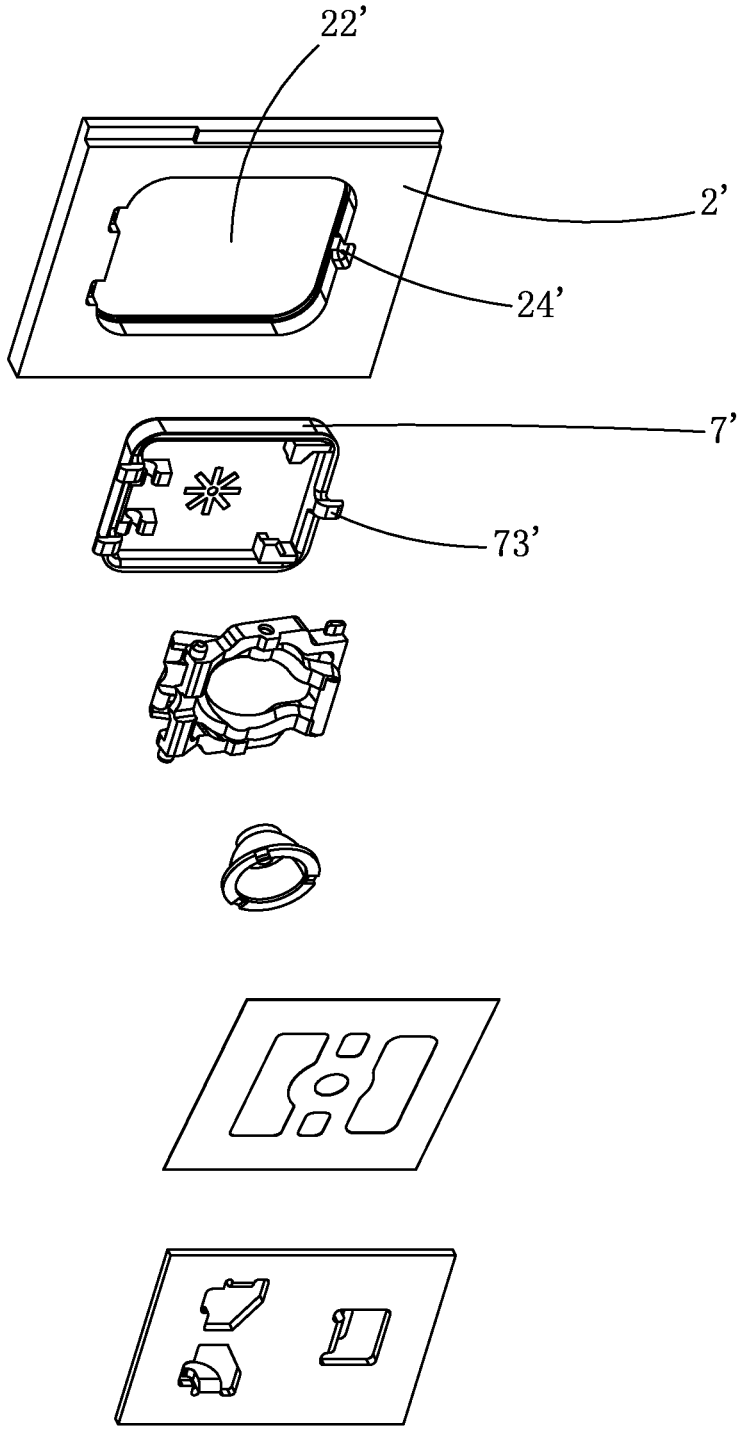
FIG. 4 is an exploded view of a key structure of a keyboard preventable keycaps from breaking off in accordance with a second embodiment of the present invention.
Figure 5:
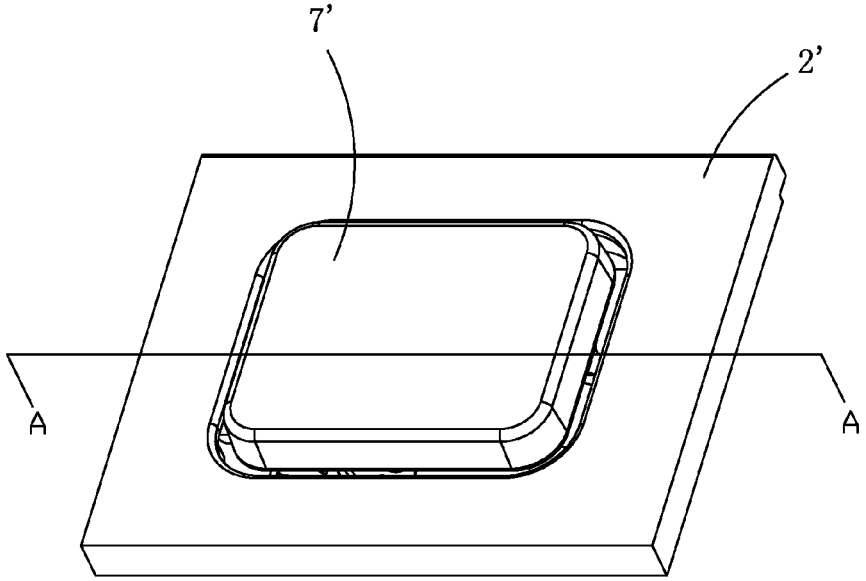
FIG. 5 is an assembled view of FIG. 4.
Figure 6:
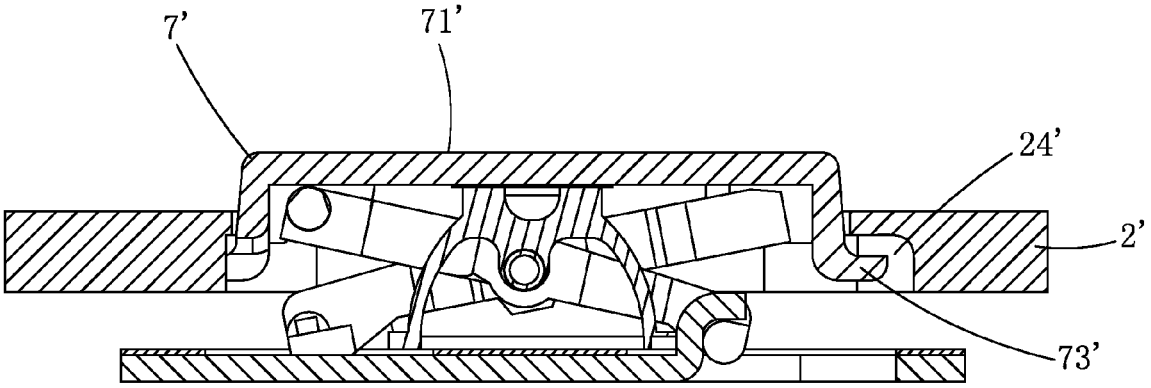
FIG. 6 is a sectional view of FIG. 5 taken along line A-A.

A keyboard preventable keycaps from breaking off in accordance with a second embodiment of the present invention is illustrated in FIGS. 4-6. Comparing to the first embodiment, a bottom surface of a limit board 2' away from a top surface 71' of a keycap 7' is provided with a recess 24' adjacent to an opening 22' and corresponding to a locking part 73', and the locking part 73' of the keycap 7' is correspondingly received in the groove 24' of the limit board 2'. By the recess 24' of the limit board 2' receiving the locking part 73', the keycap 7' can get a comparatively big stroke, which can guarantee the tactile feel of the key input and at the same time be good for making the keyboard thinner. In the present embodiment, the locking part 73' is approximately in a block shape, and the shape of the recess 24' of the limit board 2' can be configured corresponding to the shape of the locking part 73'.

Figure 7:
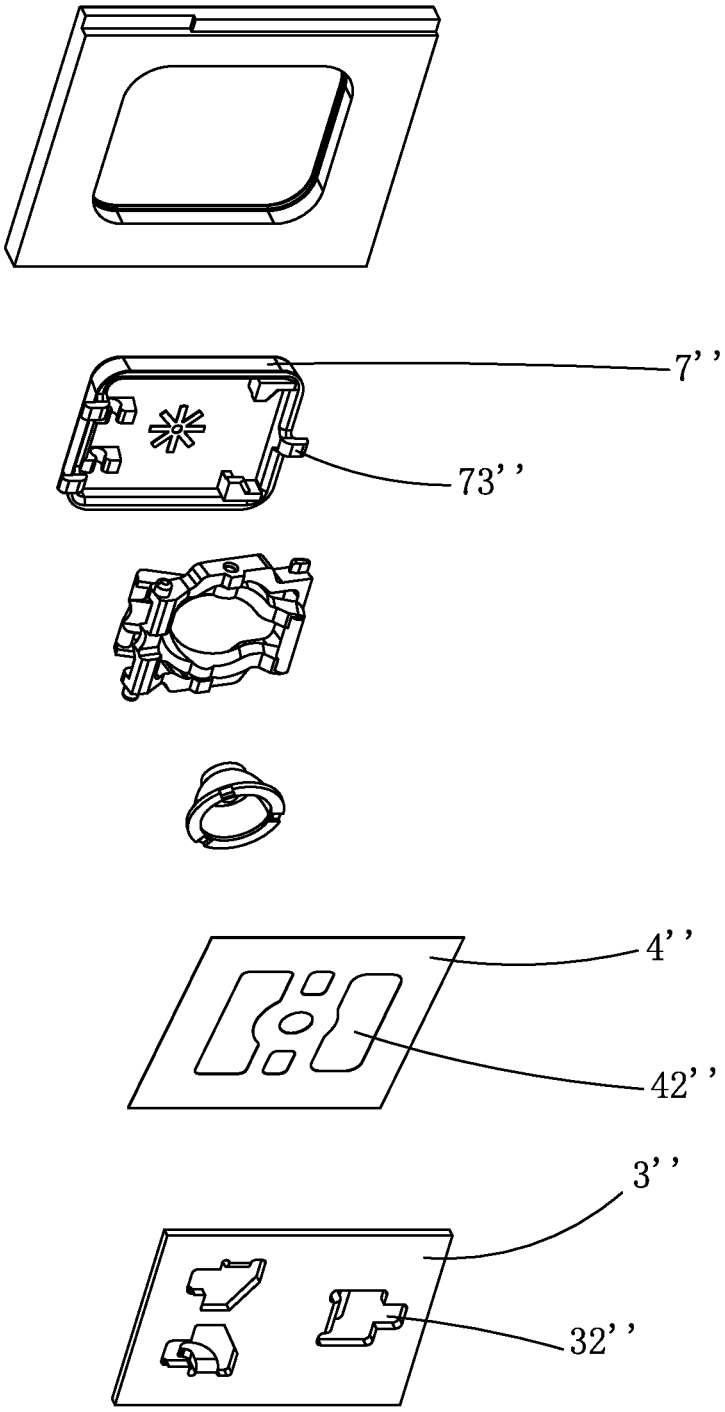
FIG. 7 is an exploded view of a key structure of a keyboard preventable keycaps from breaking off in accordance with a third embodiment of the present invention.
Figure 8:
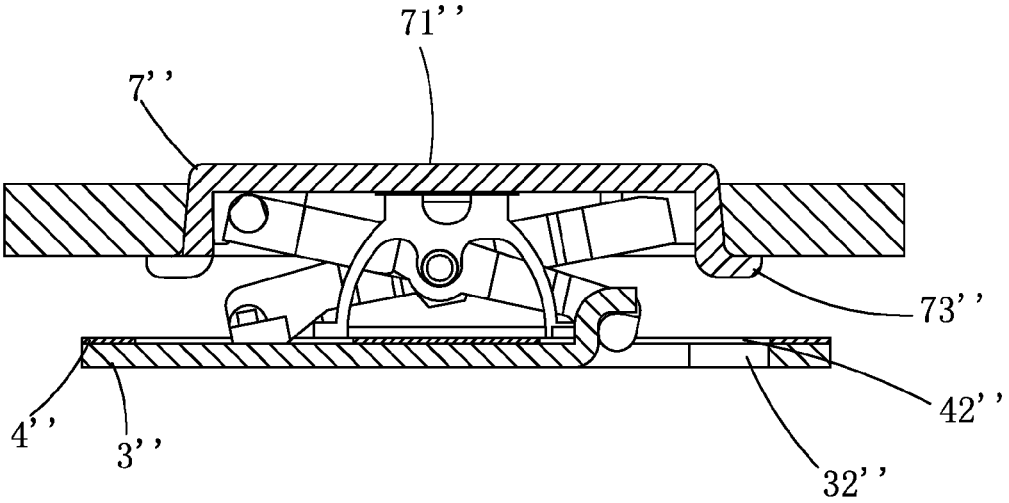
FIG. 8 is a sectional assembled view of FIG. 7.
Figure 9:
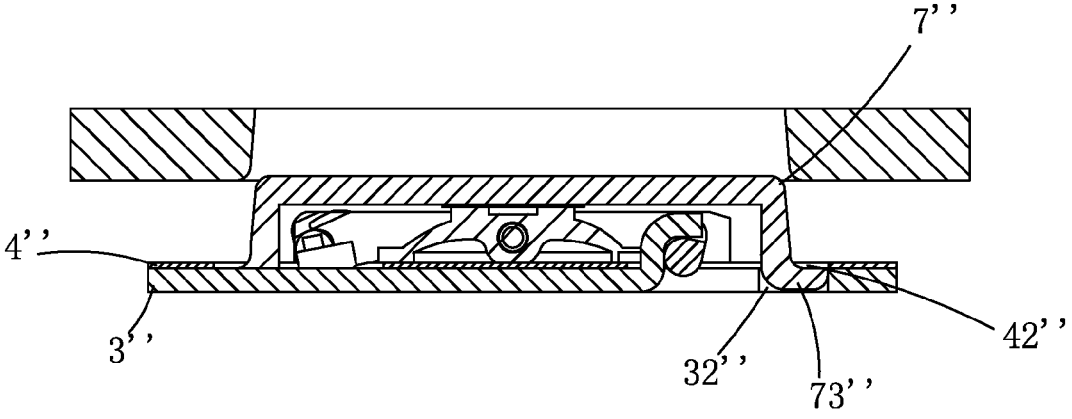
FIG. 9 is a schematic view of FIG. 8 showing the working state.

A keyboard preventable keycaps from breaking off in accordance with a third embodiment of the present invention is illustrated in FIGS. 7-9. Comparing to the first embodiment, a base board 3" is provided with a groove 32" corresponding to a locking part 73". While pressing a keycap 7", the locking part 73" of the keycap 7" is correspondingly received in the groove 32" of the base board 3". As an alternative of the present embodiment, a thin film circuit board 4" is provided with a through hole 42" corresponding to the groove 32" of the base board 3", and while pressing the keycap 7", the locking part 73" of the keycap 7" passes through the through hole 42" to be received in the groove 32" of the base board 3". By the groove 32" of the base board 3" receiving the locking part 73", the keycap 7" can get a comparatively big stroke, which can guarantee the tactile feel of the key input. In the present embodiment, the locking part 73" is approximately in a block shape, and the shape of the groove 32" of the base board 3" can be configured corresponding to the shape of the locking part 73".

Figure 10:
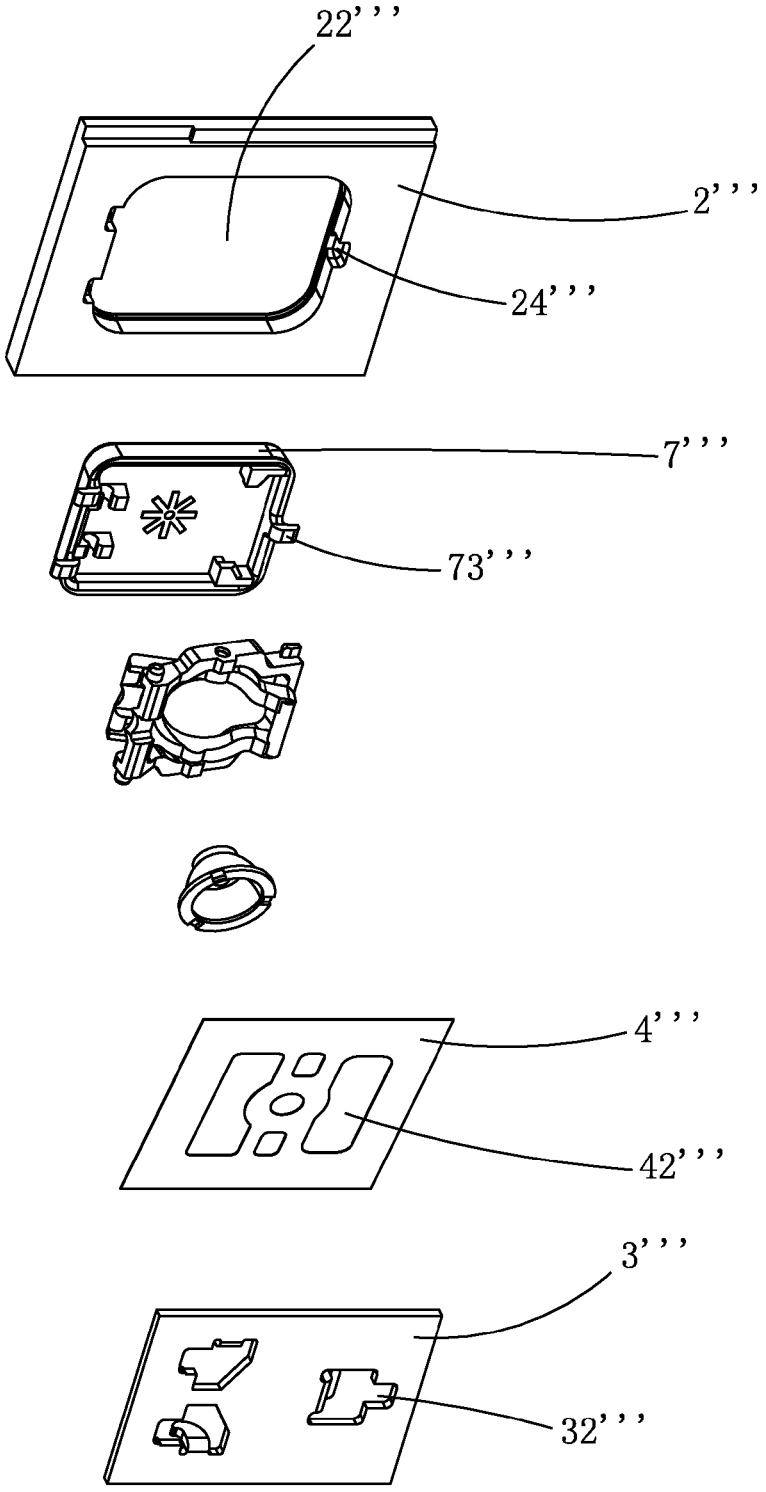
FIG. 10 is an exploded view of a key structure of a keyboard preventable keycaps from breaking off in accordance with a fourth embodiment of the present invention.
Figure 11:
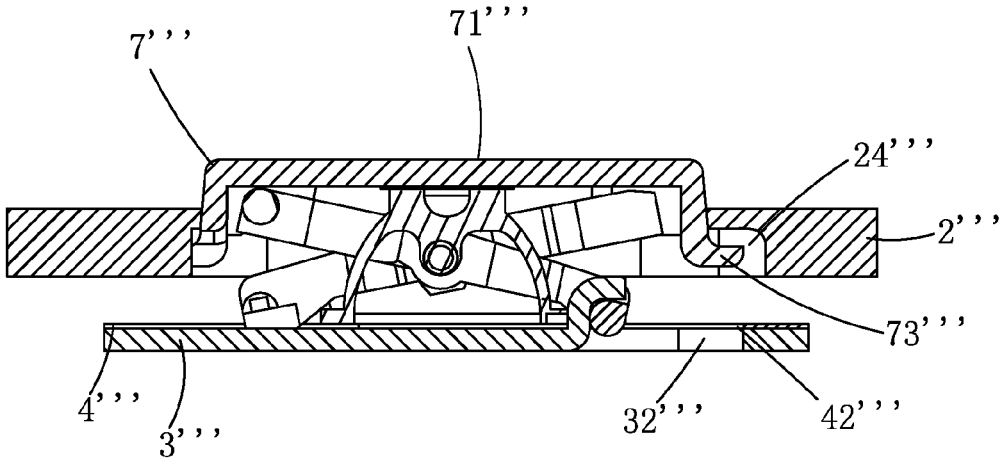
FIG. 11 is a sectional assembled view of FIG. 10.
Figure 12:
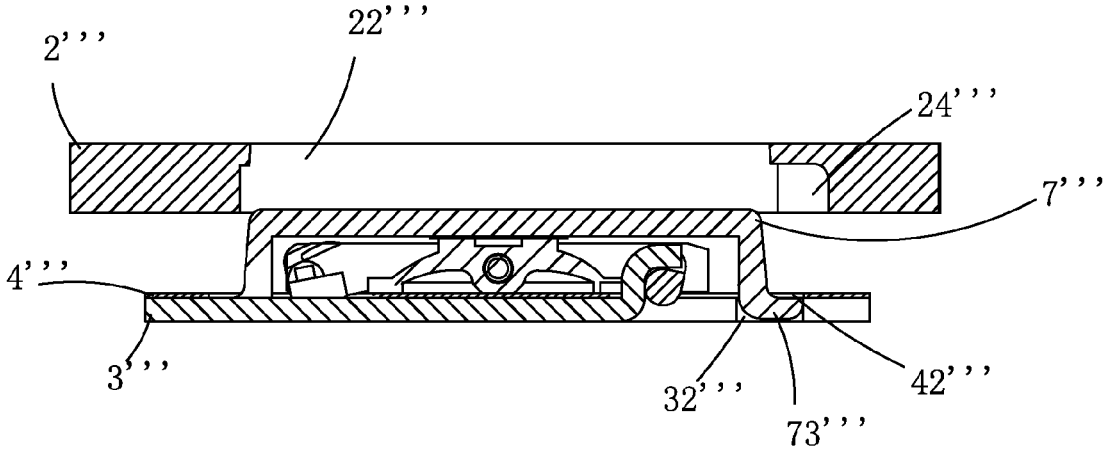
FIG. 12 is a schematic view of FIG. 11 showing the working state.

A keyboard preventable keycaps from breaking off in accordance with a fourth embodiment of the present invention is illustrated in FIGS. 10-12. Comparing to the first embodiment, a bottom surface of the limit board 2''' away from a top surface 71''' of a keycap 7''' is provided with a recess 24''' adjacent to an opening 22''' and corresponding to a locking part 73'''. A base board 3''' is provided with a groove 32''' corresponding to the locking part 73'''. The locking part 73''' of the keycap 7''' is correspondingly received in the recess 24''' of the limit board 2'''. While pressing the keycap 7''', the locking part 73''' of the keycap 7''' is correspondingly received in the groove 32''' of the base board 3'''. As an alternative of the present embodiment, a thin film circuit board 4''' is provided with a through hole 42''' corresponding to the groove 32''' of the base board 3'''. While pressing the keycap 7''', the locking part 73''' of the keycap 7''' passes through the through hole 42''' to be received in the groove 32''' of the base board 3'''. By the recess 24''' of the limit board 2''' and the groove 32''' of the base board 3''' receiving the locking part 73''', the keycap 7''' can further get a bigger stroke, which can guarantee the tactile feel of the key input and at the same time be good for making the keyboard as a whole thinner. In the present embodiment, the locking part 73''' is approximately in a block shape, and the shape of the recess 24''' of the limit board 2''' and the shape of the groove 32''' of the base board 3''' can all be corresponding to the shape of the locking part 73'''.

In summary, the present invention provides a keyboard preventable keycaps from breaking off, which can effectively prevent the keycap from breaking off under an external force. Furthermore, the keyboard has a certain dustproof function, has more stable keycaps, is efficient and durable to use, and is good for making the keyboard as a whole thinner. By the recess of the limit board receiving the locking part, the keycap can get a comparatively big stroke, which can guarantee the tactile feel of the key input and at the same time be good for making the keyboard as a whole thinner. Moreover, by the groove of the base board receiving the locking part, the keycap can further get a bigger stroke, and the tactile feel of the key input can be further improved.

Although the present invention has been described in detail with above said embodiments, but it is not to limit the scope of the invention. So, all the modifications and changes according to the characteristic and spirit of the present invention, are involved in the protected scope of the invention.

What is claimed is:

1. A keyboard preventing keycaps from breaking off comprising a keyboard main body, and a limit board mounted to the keyboard main body;

the keyboard main body comprising a base board, a thin film circuit board mounted on the base board, an elastic body mounted above the thin film circuit board, a scissors structure, and a keycap;

a centre of the scissors structure being provided with a hollow part;

the elastic body being located above the thin film circuit board and in the hollow part at the centre of the scissors structure;

the keycap being located on the elastic body;

the scissors structure being mounted to the keycap and passing through the thin film circuit board to be moveably mounted to the base board;

the keycap comprising a top surface and side surfaces connected with the top surface, and the side surface being provided with a locking part extending outwards therefrom;

the limit board being provided with a plurality of openings corresponding to keycaps, the keycaps passing through the openings, and the limit board covering the locking parts;

wherein a bottom surface of the limit board away from the top surface of the keycap is provided with a recess adjacent to the opening and corresponding to the locking part, and the locking part of the keycap is correspondingly received in the recess of the limit board;

wherein the base board is provided with a groove corresponding to the locking part, and while pressing the keycap, the locking part of the keycap is correspondingly received in the groove of the base board;

wherein the thin film circuit board is provided with a through hole corresponding to the groove of the base board.

2. The keyboard preventing keycaps from breaking off of claim 1, wherein the locking part is parallel to the top surface, and the side surface is perpendicular to the top surface.

3. The keyboard preventing keycaps from breaking off of claim 1, wherein the limit board is made of metal or plastic materials.

* * * * *